United States Patent [19]

Sakai et al.

[11] Patent Number: 4,538,329

[45] Date of Patent: Sep. 3, 1985

[54] DRAFT DEVICE

[75] Inventors: Shoji Sakai; Michiaki Fujiwara; Nobunori Kubota, all of Kyoto; Koshi Noda, Joyo, all of Japan

[73] Assignee: Murata Kikai Kabushiki Kaisha, Kyoto, Japan

[21] Appl. No.: 316,298

[22] Filed: Oct. 29, 1981

[30] Foreign Application Priority Data

| | | | |
|---|---|---|---|
| Oct. 31, 1980 | [JP] | Japan | 55-155887[U] |
| Oct. 31, 1980 | [JP] | Japan | 55-155888[U] |
| Nov. 7, 1980 | [JP] | Japan | 55-159946[U] |

[51] Int. Cl.[3] ..... D01H 5/86; D01H 5/46

[52] U.S. Cl. ..... 19/244; 19/250; 19/258; 19/267

[58] Field of Search ..... 19/244, 250, 252, 253, 19/254, 277, 267, 258

[56] References Cited

U.S. PATENT DOCUMENTS

| | | | |
|---|---|---|---|
| 2,357,243 | 8/1944 | Walker | 19/252 |
| 2,708,290 | 5/1955 | Neu et al. | 19/255 X |
| 2,884,664 | 5/1959 | Solanas | 19/267 |
| 2,941,262 | 6/1960 | Schiltknecht | 19/254 |
| 3,038,213 | 6/1962 | Krämer et al. | 19/253 X |
| 3,050,789 | 8/1962 | Rogner | 19/252 |
| 3,120,681 | 2/1964 | Stahlecker | 19/252 |
| 3,222,731 | 12/1965 | Krämer | 19/252 |
| 3,412,434 | 11/1968 | Fusaroli | 19/267 |
| 4,097,964 | 7/1978 | Herubel | 19/244 X |

*Primary Examiner*—Louis Rimrodt

*Attorney, Agent, or Firm*—Spensley Horn Jubas & Lubitz

[57] ABSTRACT

A draft device for a spinning machine comprises a plurality of pairs of a top roller and a bottom roller, a draft cradle for supporting shafts of the top roller and a belt tenser. Top roller shafts are supported by a top roller support which is rotatably supported on a frame at one end thereof and side plates for fitting the top roller shafts therein, and spring members for pressing the roller shafts are disposed within the top roller support. A tenser of the belt tenser has an engaging portion wherein the top roller shaft is loosely fitted.

6 Claims, 9 Drawing Figures

DRAFT DEVICE

BACKGROUND OF THE INVENTION

In the conventional draft device as shown in FIG. 9, when top roller shafts 1', 2' and 3' of back, middle and front top rollers 1, 2 and 3 are supported, the centers of the shafts are pivoted on a cradle 4 and the respective rollers are located on both the sides of the cradle, and the cradle per se is supported at one point 5 with a shaft 6 and the free end 7 of the cradle is elastically pressed toward bottom rollers, whereby a nip pressure is produced between the top rollers 1, 2 and 3 and the corresponding bottom rollers (not shown).

However, in the case where the draft cradle 4 is supported only at the rear end portion 5, slight shaking at the fulcrum is enlarged at the front portion 7, and therefore, a precise space cannot be maintained between the top rollers 3 and the bottom roller (not shown) and the nip pressure between the two rollers can be maintained at a predetermined level.

While, since the roller shafts 1', 2' and 3' are pivoted at the central portions thereof on the cradle and the left and right ends of the shafts 1', 2' and 3' are kept in the free state, shaking is sometimes caused in the roller shafts 1', 2' and 3'. Moreover, there has been an undesirable phenomenon in which when the drafting operation is stopped and a draft cradle is lifted up, an apron which is mounted to surround top rollers and tensers supported on the draft cradle is set in the deformed state at the position having abutting contact with the tensers by long-time stoppage and it is impossible to perform uniform drafting on resumption of the drafting operation.

SUMMARY OF THE INVENTION

The present invention relates to a draft device of a spinning machine. More specifically, the present invention relates to a draft cracle and a belt tenser of the draft device.

It is a primary object of the present invention to maintain an equal nip pressure in a draft device of a spinning unit comprising back, middle and front rollers during the drafting operation.

It is another object of the present invention to provide a draft device with an apron which is loosened and is released from pressing contact with the tenser or top rollers when the draft cradle is lifted up.

The present invention is characterized in that a top roller support of a draft cradle can be fixed to a frame at both the front and rear ends during the drafting operation, a spring member elastically pressing the central portion of each of the top roller shafts of the back, middle and front top rollers toward the corresponding bottom rollers is supported at the central portion thereof on a frame and side plates are arranged on the frame so that the respective roller shafts are supported in the freely fit-in state while arranging the respective roller shafts in parallel to one another with a certain space being formed between the centers of every two adjacent shafts.

DETAILED DESCRIPTION OF THE INVENTION

Figure 1:
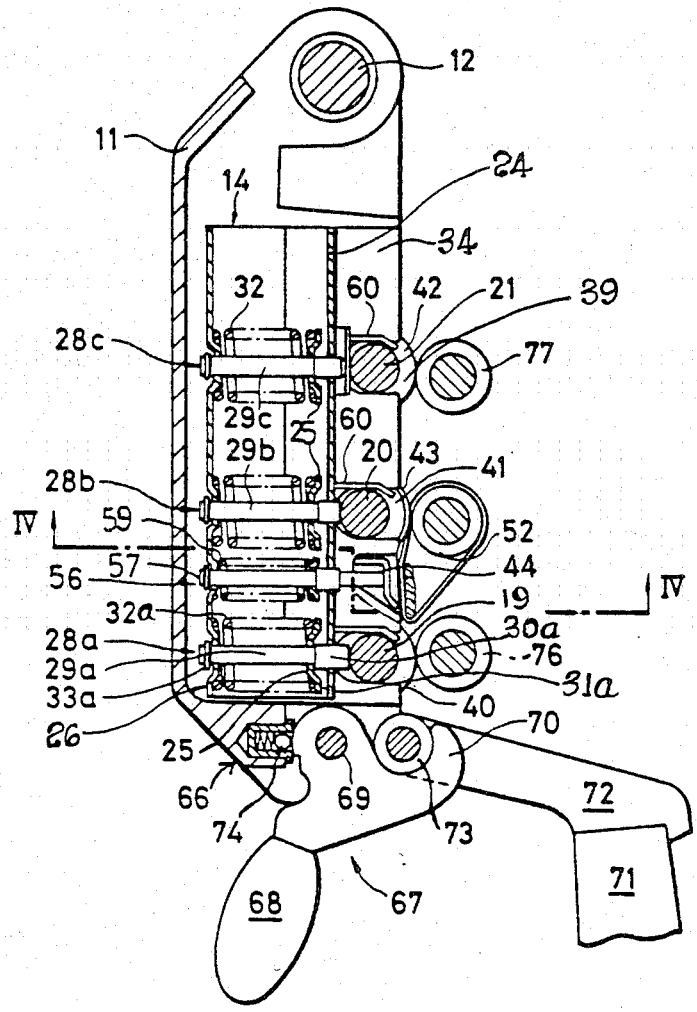
FIG. 1 is a partially longitudinally sectional side view illustrating one embodiment of the present invention.

One embodiment of the present invention will now be described in detail with reference to the accompanying drawings.

A top roller support 11 is supported on a frame (not shown) by a shaft 12. A spring 13 (see FIG. 2) urges the top roller support 11 to rotate in the clockwise direction in FIG. 1. The top roller support 11 has a shape of a square box having a relatively large width and in the interior of the top roller support 11, a spring box 14 having a substantially □-shaped section is fixed by screws 15. Side plates 34 and 35 are fixed on both the sides of the top roller support 11 by screws 36. Notches 37, 38 and 39 are side plates 34 and 35 and a top roller shafts 19, 20 and 21 are slidably fitted in the notches 37, 38 and 39. A stopper 60 is disposed to prevent the top roller shafts 19, 20 and 21 from falling out from the notches 37, 38 and 39. In the embodiment shown in FIGS. 1 and 2, there are arranged three top roller shafts, that is, a front top roller shaft 19, a middle top roller shaft 20 and a back top roller shaft 21.

The spring box 14 comprises a lower part 24 with a flange 23 on the top end thereof and an upper part 26 having a flange 25, and the flanges 23 and 25 are combined to form a □-shaped cross-section of the spring box 14 and these flanges 23 and 25 are secured to the top roller support 11 by the screws 27. The spring box 14 is extended along the central line of the top roller support 11 in the longitudinal direction thereof and is located so that the spring box 14 strides front, middle and back top roller shafts 19, 20 and 21 described hereinafter. Spring members **28*a*, 28*b* and 28*c* are hung on the upper part 26 at positions corresponding to the respective top roller shafts 19, 20 and 21, respectively. Since the spring members 28*a*, 28*b* and 28*c* have the same structure, the structure of the spring member 28*a* along will now be described and explanation of the structures of the spring members 28*b* and 28*b* is omitted through suffixes b and c are added to parts of the spring members 28*b* and 28*c* corresponding to the parts of the spring member 28*a*. A roller shaft pressing bar 29*a* is slidably supported by the upper and lower part 26 and 24, and a saucer member 31*a* is anchored on a step portion 30*a* on the end of the roller shaft pressing bar 29*a* and a spring 32*a* is laid out between the upper saucer 26 and the saucer member 31*a*, so that the roller shaft pressing bar 29*a* is urged to project to the right in FIG. 1. Reference numeral 33*a* represent a stopper. The same space as the space formed among the front, middle and back top roller shafts 19, 20 and 21 is formed among the roller shaft pressing bars 29*a*, 29*b* and 29*c***.

Side plates 34 and 35 are secured to both the side faces of the top roller support 11 by screws 36. Notches 37, 38 and 39 are formed on the side plates 34 and 35 so that the space among these notches 37, 38 and 39 is the same as the space among the front, middle and back top roller shafts 19, 20 and 21, and these shafts 19, 20 and 21 are slidably fitted in the notches 37, 38 and 39. Front, middle and back top rollers 40, 41 and 42 are mounted on both the end portions of the roller shafts 19, 20 and 21, respectively. An apron 43 is mounted on the middle top roller 41 and a tenser 44 is arranged in the apron 43.

Figure 8:
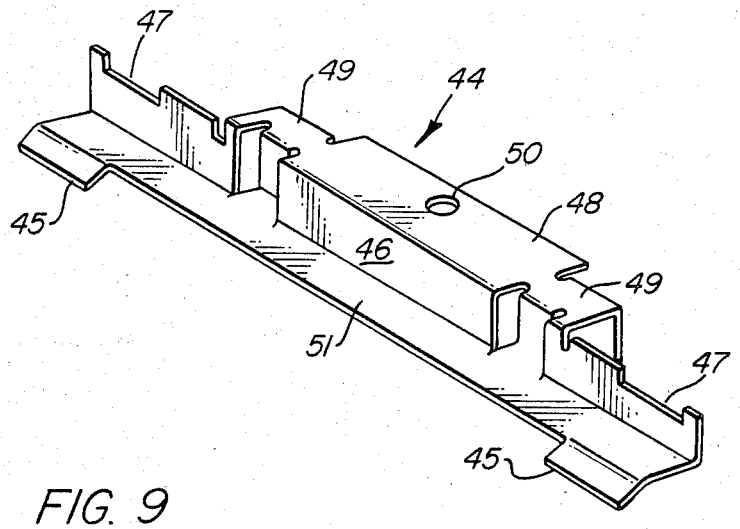
FIG. 8 is a perspective view showing the belt tenser of the present invention.
Figure 9:
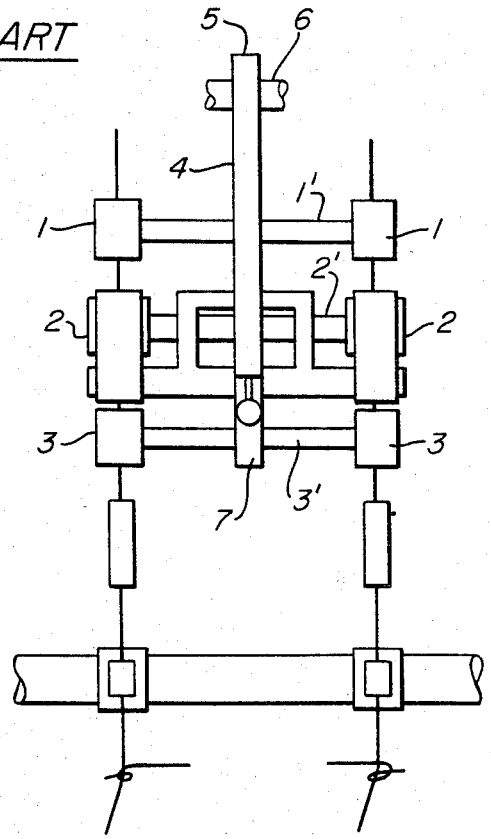
FIG. 9 PRIOR ART
FIG. 9 is a schematic front view showing the conventional device.

The tenser 44 has a shape as shown in FIG. 8. The tenser 44 has substantially the same length as that of the middle top roller shaft 20 and the central portion of the tenser 44 has a substantially L-shaped cross-section. The tenser 44 is projected slightly downwardly so that the apron 43 is supported by front edges 45 on both the sides of the tenser 44, and guiding cut-out portions 47 are formed on both the sides of a rising portion 46 of the tenser 44 to guide the apron 43. A horizontal blade member 48 is arranged at the center of the rising portion 46 to receive the middle top roller shaft 20 on the lower face thereof. On both the sides of the horizontal blades 48, reverse-shaped engaging members 49 are arranged at the rear end at the rear end edges of the rising portion 46. A hole 50 is formed for insertion of the pressing bar **29*b* of the spring member 28*b* described hereinafter. The tenser 44 is pressed by the spring member 56 so that the tenser 44 is brought into pressing contact with an apron 58 of the middle bottom roller 52. The spring member 56 has a structure similar to the structure of the spring member 28, and the spring member 56 is fitted and supported between the upper and lower walls 26 and 24 of the spring box 14 so that the spring member 56 can make a springing movement. The pressing bar 57 having the top end pressed to the tenser 44 is pressed to an L-shaped horizontal plane 51 of the tenser 44 by means of a spring 59, whereby the apron 43 is maintained under tension. The roller shafts 19, 20 and 21 are prevented from falling out by stoppers 60 mounted on the side portions of the notches 37, 38 and 39. Each stopper 60 has an annular bent part 61 in the upper portion thereof and the bent part 61 is pressed to the top roller support 11 by projections 62 formed on the side plates 34 and 35 to secure the stopper 60**.

An engaging member 67 is mounted on the free end 66 of the top roller support 11. The engaging member 67 comprises a handle 68 supported on a shaft 69, and by engaging a hook 70 on the top end of the handle 68 with a roller 73 on the top end of an arm 72 mounted on a frame 71, the top roller support 11 is fixed to the frame so that the top roller support 11 can be disengaged from the frame. A stopper 74 is arranged so that when the engaging member 67 is disengaged from the frame, it is fixed by the stopper 74.

Figure 2:
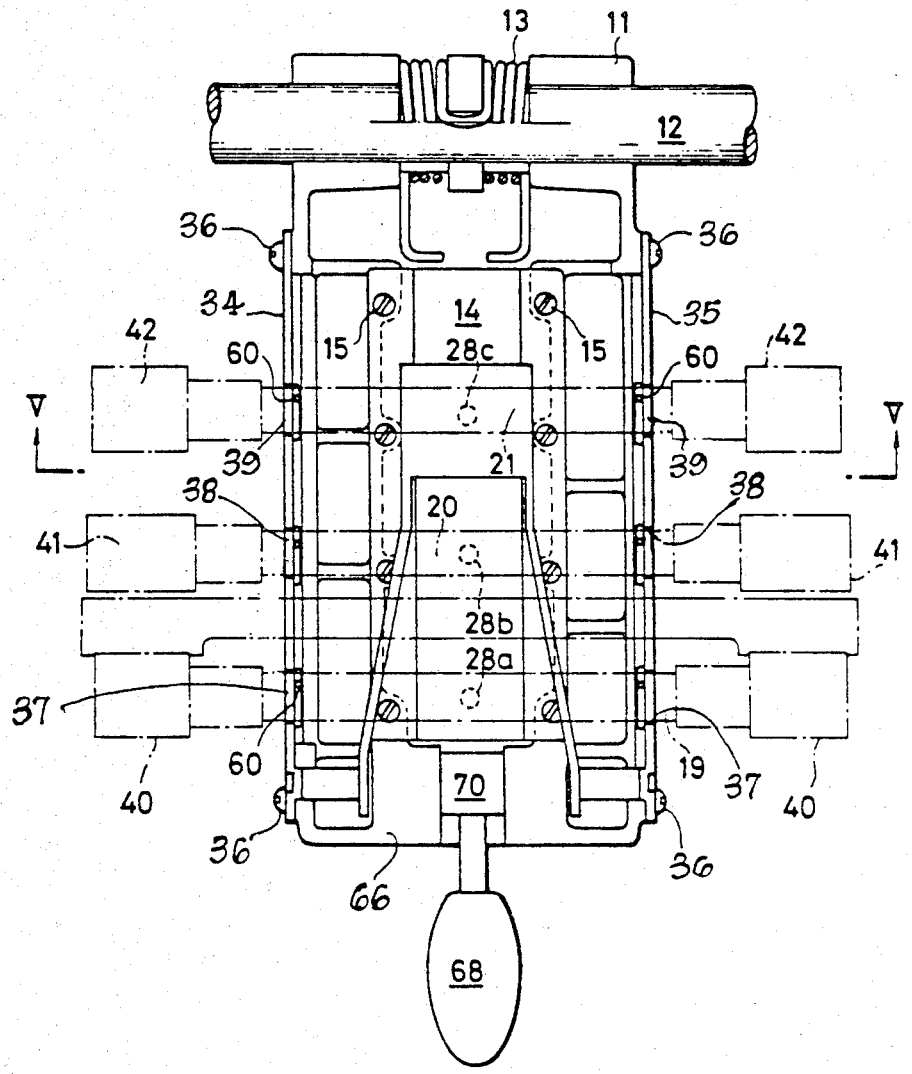
FIG. 2 is a bottom view illustrating the device shown in FIG. 1.
Figure 3:
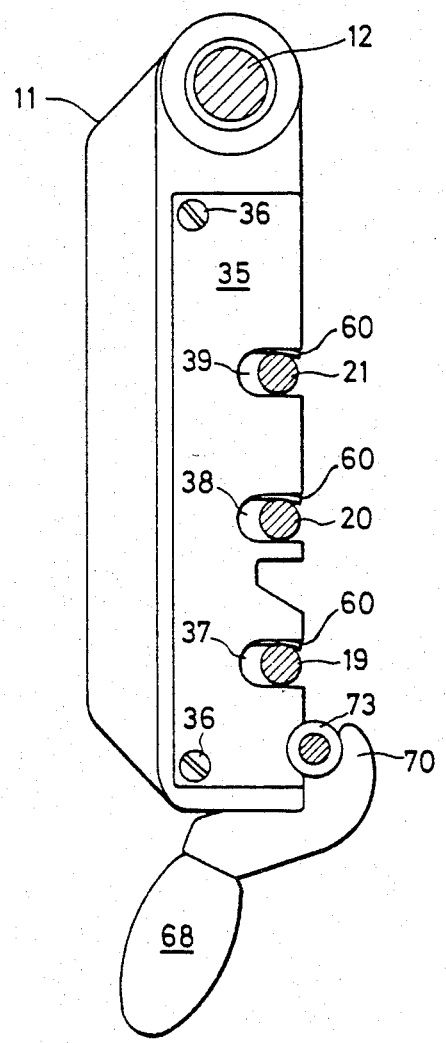
FIG. 3 is a side view of the device shown in FIGS. 1 and 2.
Figure 4:
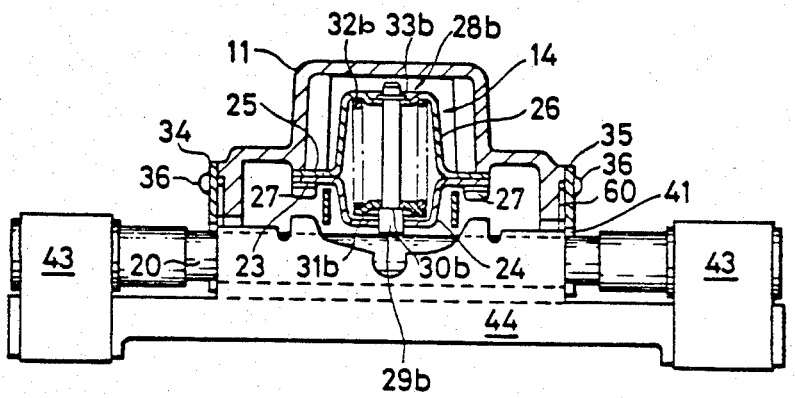
FIG. 4 is a view showing the section taken along the line IV—IV in FIG. 1.
Figure 5:
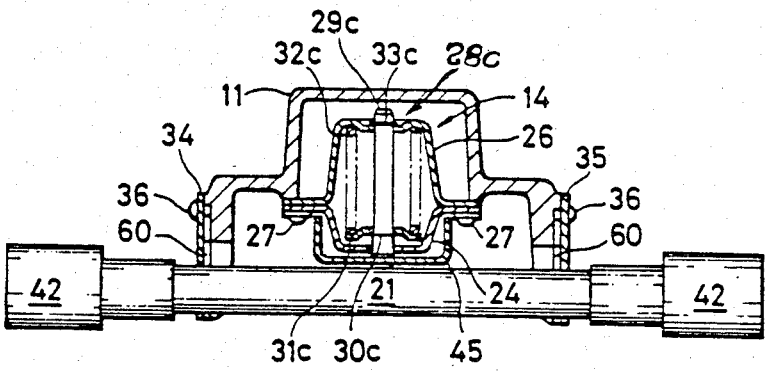
FIG. 5 is a view showing the section taken along the line V—V in FIG. 2.
Figure 7:
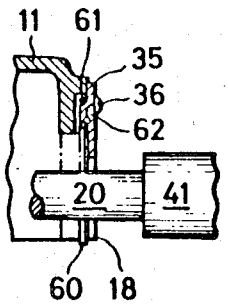
FIG. 7 is a view showing the section of the end portion of the cradle, taken along the line VII—VII in FIG. 6.

In the draft cradle of the present invention having the above-mentioned structure, during the normal drafting operation, as shown in FIG. 1, the hook 70 of the engaging member 67 is engaged with the roller 73 of the arm 72. Accordingly, a top rollers 40, 41 and 42 integrated with each top roller shafts 19, 20 and 21 are kept in abutting contact with a bottom rollers 76, 52 and 77, and the top roller shafts 19, 20 and 21 receive at the center thereof an elastic force of the springs **32*a*, 32*b* and 32*c* through the roller shaft pressing bars 29*a*, 29*b* and 29*c* of the top roller pressing member 23**.

In the draft cradle of the present invention, one end of the top roller support 11 is supported at the shaft 12 on the frame and the free end 66 thereof is fixed to the frame by the engaging member 67, whereby the top roller support 11 is supported on both the ends thereof. Accordingly, the top rollers 40, 41 and 42 mounted on both the left and right sides of the top roller shafts 19, 20 and 21 are allowed to abut against the corresponding bottom rollers 76, 52 and 77 under the substantially same pressure, and moreover, a substantially equal nip pressure can be maintained without any deviation between the top rollers mounted on the respective top roller shafts and the corresponding bottom rollers.

Moreover, since the central portions of the respective roller shafts 19, 20 and 21 are pressed by the elastic forces of the springs **32*a*, 32*b* and 32*c* of the spring members 28*a*, 28*b* and 28*c*, the respective top rollers 40, 41 and 42 supported on both the sides of the respective roller shafts are brought into contact with the corresponding bottom rollers 76, 52 and 77 under an equal nip pressure. Furthermore, since the top roller shafts 19, 20 and 21 slide in the state where they are fitted in the notches 37, 38 and 39 of the side plates 34, and 35, shaking of the end portions of the shafts 19, 20 and 21 is not caused to occur at all and the respective top roller shafts can be rotated in the state where they are always kept in parallel to one another. Therefore, in the apparatus of the present invention, occurrence of drafting unevenness can be prevented effectively. During the normal drafting operation, since the lower end portion of the pressing bar 57 of the spring member 56 is pressed to the L-shaped horizontal plane 51 of the tenser 44 by the elastic force of the spring 59, the front end edges 45 of the tenser 44 push out the apron 43 from the interior toward the periphery to maintain the apron 43** under tension.

Figure 6:
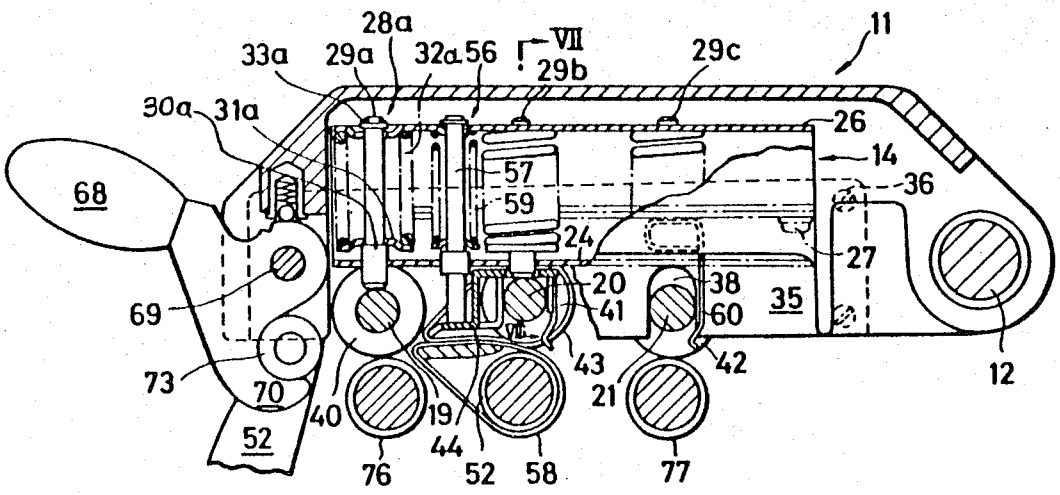
FIG. 6 is a sectional side view showing a cradle provided with the belt tenser of the present invention.

When the drafting operation is stopped in this state and the handle 68 is operated to turn the top roller support 11 in the clockwise direction in FIG. 6 with the shaft 12 being as the center, the middle top roller shaft 20 is allowed to slide downward in the notches 38 by the action of gravity and to shift beyond the point of the maximum projection quantity of the pressing bar **29*b*, with the result that the middle top roller shaft 20 does not undergo the pressing action of the pressing bar 29*b* any longer. Also the tenser 44 engaged with the middle top roller 41 is brought down by the engaging member 49 and does not undergo the pressing action of the pressing bar 57 of the spring member 56 any longer. Accordingly, the distance between the front end edge 45 of the tenser 44 and the center of the middle top roller shaft 20 is reduced, with the result that the force of pressing the apron 43 toward the periphery from the interior is weakened and the apron 43** is released from tension.

As will be apparent from the foregoing description, in the device of the present invention, only by lifting up the cradle, the top roller shafts supported on the top roller support and the apron supported on said top roller shaft can be released from tension. Therefore, deformation of the apron caused during the stoppage of the drafting operation can be prevented effectively.

What is claimed is:

1. A drafting device for a spinning machine, including a machine frame and a plurality of pairs of double rollers placed in series and adapted to run in parallel, each of said pairs comprising a top double roller and a bottom double roller, wherein each of the top double rollers is supported by a common shaft and the common shafts of said top double rollers are supported in a top roller support, and wherein one of the pairs of double rollers is provided with endless aprons and is adapted to be an apron drafting mechanism and have its top rollers provided with a tenser for tensioning said aprons, characterized in that the top roller support for supporting the shafts of the top rollers is pivotably supported at one of its ends at the machine frame, and that an engaging member is disposed at the other free end of the top roller support for releasably securing the top roller support to the machine frame.

2. A drafting device as claimed in claim 1, wherein side plates are attached to each of two sides of the top roller support, each of said side plates being provided with notches along the lower edge of the plates into which the shafts of the top rollers are slidably fitted, the device further comprising spring means mounted to the top roller support above the central portion of each of shafts, for resiliently supporting each of the shafts, said spring means having a bar for each shaft which extends perpendicularly to the shaft, said bar having its end resiliently pressed against the central portion of the associated shaft.

3. A drafting device as claimed in claim 1, wherein said tenser of the top rollers provided with aprons has a horizontal front surface which has two front-end edges extending in parallel to the axis of the top rollers for tensioning and supporting the aprons from the inside, and engaging members, adapted to receive and loosely grip the shaft of the associated upper rollers.

4. A drafting device as claimed in claim 3, wherein the device further comprises a compression spring and a bar adapted, during operation of the drafting devices, to press the bottom end of the bar against the horizontal front surface of the tenser wherein the front portion of the tenser is pressed downward so as to exert a pressure on the aprons with which the bottom rollers are provided, and exert a force on the inside of the aprons, which holds the aprons of the top rollers under tension.

5. A drafting device as claimed in claim 4, wherein said drafting device further comprises means for allowing the top apron roller shaft and the tenser to shift when the top roller support is raised during stopped operation, so that the tenser is no longer subjected to the pressing action of the bar and the distance between the front edges of the tenser and the center of the shaft received by the engaging members of the tenser is reduced and the top roller aprons are released from tension.

6. A drafting mechanism for textiles comprising: a frame having a plurality of bottom rollers rotatably supported on said frame; top roller support pivotally coupled at one end thereof to said frame, said top support having a like plurality of top rollers; and latch means for releasably latching said top roller support to said frame wherein said latch means comprises a projecting member located on the end of the frame opposite to that at which said top roller support is pivotally coupled, and a hook pivotally coupled to the distal end to the top roller support, for engaging the projecting member, wherein the top roller support is latched to the frame by the engagement of the hook with the projecting member; said hook further including a handle whereby said hook may be pivoted from a first position of engagement with said protecting member to a second position of disengagement from said projecting member, and whereby further movement of said handle in the same direction will cause said top roller support to pivotally separate from said frame; and wherein motion of said handle is an opposite direction will pivot said top roller support from the position in which it is pivotally separated from said frame to the position wherein the top rollers are in contact with the bottom rollers while said hook remains disengaged from said protecting member, and wherein further continued motion of said handle will move said hook to the position whereat it is engaged with said protecting member.

* * * * *